US006959810B2

(12) United States Patent
Neilson

(10) Patent No.: US 6,959,810 B2
(45) Date of Patent: Nov. 1, 2005

(54) CASE FOR STORING, CARRYING AND DISPLAYING A HANDHELD STRINGED MUSICAL INSTRUMENT

(76) Inventor: George Erik Neilson, 561 W. 740 North, Orem, UT (US) 84057

( * ) Notice: Subject to any disclaimer, the term of this patent is extended or adjusted under 35 U.S.C. 154(b) by 128 days.

(21) Appl. No.: 10/429,071

(22) Filed: May 2, 2003

(65) Prior Publication Data

US 2004/0217026 A1 Nov. 4, 2004

(51) Int. Cl.[7] ..... A45C 11/00
(52) U.S. Cl. ..... 206/314; 206/45.23; 206/204
(58) Field of Search ..... 206/14, 314, 204, 206/213.1, 45.2, 45.21, 45.23, 45.24; 84/453; 312/31, 31.03–31.06

(56) References Cited

U.S. PATENT DOCUMENTS 4,147,254 A 4/1979 Bruce
4,223,785 A 9/1980 Jacques
4,259,568 A * 3/1981 Dynesen ..... 206/45.2
4,474,290 A 10/1984 DeMato
5,193,672 A * 3/1993 Long ..... 206/45.2
5,833,051 A 11/1998 Tiefenbrun et al.
5,927,487 A * 7/1999 Whittle et al. ..... 206/45.2
5,934,773 A * 8/1999 Ferrell ..... 206/204
5,936,178 A * 8/1999 Saari ..... 84/453
6,029,804 A * 2/2000 Flynn ..... 206/14
6,209,717 B1 * 4/2001 Flynn ..... 206/314
6,454,097 B1 * 9/2002 Blanco ..... 206/570
6,755,396 B1 * 6/2004 Weinrich ..... 261/30

* cited by examiner

*Primary Examiner*—Luan K. Bui
(74) *Attorney, Agent, or Firm*—Angus C. Fox, III

(57) ABSTRACT

A case for storing, carrying and displaying a handheld stringed musical instrument includes a main body incorporating an instrument receptacle, the body having a narrowed upper end portion for receiving the neck of the instrument and a widened lower end portion for receiving the body of the instrument, the case further including an articulated cover securable to the main body for reversably covering the instrument receptacle, the cover also being hingeably connected along a linear edge of the widened lower end portion of the body, foldable beneath the main body, and attachable to a medial portion of the back side of the main body. The case may also incorporate a humidifier in a portion of the case below where the neck of the instrument is positioned. The humidifier includes a container having a perforated lid. A damp sponge is placed within the container, thereby maintaining a relatively constant level of humidity within the case, when closed.

16 Claims, 13 Drawing Sheets

CASE FOR STORING, CARRYING AND DISPLAYING A HANDHELD STRINGED MUSICAL INSTRUMENT

BACKGROUND OF THE INVENTION

1. Field of the Invention

This invention generally relates to carrying and display cases for musical instruments and, more particularly, to a carrying cases for a hand-held stringed musical instruments which convert to free-standing display cases therefor.

2. Description of the Prior Art

Musical instruments are typically delicate and expensive devices. If roughly handled, metal wind instruments are subject to denting, bending and breakage. Acoustic stringed instruments, such as violins, violas, cellos, contrabasses, and guitars, are even more delicate, as acoustic requirements necessitate that they be fabricated from thin, single-ply wood sheets, which have been precisely carved and glued together. Not only are they structurally fragile, they can be damaged by extreme changes of temperature and humidity. Because the manufacture of acoustic stringed instruments requires a high degree of craftsmanship that is not easily duplicated by machine, the cost of such instruments ranges from expensive to astronomically expensive. As a consequence of the somewhat whimsical nature of the growth process, some pieces of wood, and the stringed instruments made from them, are inexplicably better than others. An exceptional violin can easily cost in excess of $100,000. Those handcrafted by Stradivari in the early eighteenth century can sell for millions.

Because of the delicate nature of stringed handheld instruments, the prior art is replete with carrying cases of nearly every genre for such instruments. Though it is assumed that many of these cases effectively provide for the safe transport and storage of such instruments, most are more of a nuisance than an assistance to musicians at the time of performance. It has become quite common for performers of popular music, such as rock, folk, country, and rhythm and blues, to use several instruments during a concert, or even during a single piece of music. Thus, a guitar player may alternate between acoustic and electric guitars, and may even perform without a guitar while singing. A saxophone player, on the other hand, may also perform on the clarinet. Such a musician needs a structure or apparatus in which he can temporarily store the instruments used during the performance. While a number of prior art carrying cases double as instrument stands, they are typically neither convenient carrying cases nor stable instrument stands. U.S. Pat. No. 4,147,254, issued to Jeffrey S. Bruce in 1979, discloses an instrument carrying case having a pair of opposed doors, each of which is hingeably mounted to a longitudinal top edge of the case. The doors fold back to support the case in a near-vertical position. U.S. Pat. No. 4,223,785, issued to Jacques in 1980, discloses an instrument carrying case, for a stringed instrument, having a pair of opposed clamshell doors, one of which is mounted to a top longitudinal edge, the other being mounted to an adjacent lower longitudinal edge. In an open position, the doors reveal both an instrument carrying pocket and an instrument display pocket oriented at a 90-degree angle to the carrying pocket. U.S. Pat. No. 4,474,290, issued to Joseph J. DeMato in 1984, discloses a guitar case and holder combination, which can be fixed by an auxilliary support member into a partially-open position. In the partially-open position, a guitar can be supported by a central outer portion of the case in an elevated position. U.S. Pat. No. 5,833,051, issued to Jonathan Tiefenbrun and Peter J. Wilk in 1998, incorporates a folding triangular member on the bottom of the case which, when extended, supports the case in a near-vertical position. The top of the case detatches so that the lower portion can be used as an instrument stand.

In addition to the instrument carrying cases which double as instrument stands, there are a number of stands that support an instrument case in a near vertical position. U.S. Pat. No. 6,326,531, issued to Neil Bremner in 2001, is representative of that genre.

What is needed is a case for storing, carrying and displaying musical instruments, and primarily handheld stringed musical instruments. The case should be relatively compact, light weight and easy to carry, simple to manufacture, easily interconvertible between storage/carry and display modes, having a stable footprint and providing ready accessability to the instrument when used in the display mode, and protective of the instrument when used in any of the three modes.

SUMMARY OF THE INVENTION

A case for storing, carrying and displaying a handheld stringed musical instrument includes a main body incorporating an instrument receptacle, the body having a narrowed upper end portion for receiving the neck of the instrument and a widened lower end portion for receiving the body of the instrument, the case further including an articulated cover securable to the main body for reversably covering the instrument receptacle, the cover also being hingeably connected along a linear edge of the widened lower end portion of the body, foldable beneath the main body, and attachable to a medial portion of the back side of the main body. For a preferred embodiment of the invention, the linear edge is unitary with a lower panel that is obliquely inclined so as to form an obtuse angle with a back panel of the main body, thereby placing the case in a semi-recumbent position when the case is configured for display. For a preferred embodiment of the invention, the case is reclined about 20 to 30 degrees from vertical for the semi-recumbent display position.

For a prototype embodiment of the invention, the main body is constructed from a rear panel, a pair of side panels, an upper panel and a lower panel. The upper panel intersects and connects with both side panels and the rear panel, while the lower panel intersects and connects with both side panels and the rear panel. The side panels intersect and connect with the rear panel. For the main body of the prototype case, the upper panel is considerably shorter than the lower panel, resulting in a main body that is tapered, with a lower portion sized to receive the body of the stringed instrument and an upper portion sized to receive the neck of the instrument.

The prototype configuration may be modified to enhance both aesthetics and manufacturability, without departing from the basic invention. For example, the main body may be formed from a single continuous piece of vacuum-formed or injection molded polymeric plastic material, with or without reinforcing fiber content. It may also be formed from stamped aluminum, magnesium or titanium sheet metal. It may also be formed from interconnected plywood or fiberboard panels. The main body may also be shaped to more closely follow the contours of the stringed musical instrument. For example, the main body of a guitar case may approximate the shape of the instrument, as long as the lower panel of the main body incorporates a linear edge to which a cover is hingeably attached. In addition, the side, upper and lower panels may curveably interconnect with the rear panel, and the upper and lower panels may curveably interconnect with the side panels. The top may be secured to the main body with snap-lock buckles, which are manufactured from injection tough molded polymeric plastic material, such as nylon, polycarbonate or ABS. The top panel may also be secured to a medial portion of the rear panel with a snap-lock buckle, which may also be used to secure an upper portion of the top to the main body when the case is being used for storage and transport of the stringed instrument.

For a preferred embodiment of the invention, one side of the case is fitted with a carrying handle, while the opposite side is fitted with a plurality of feet, on which the case rests when it is lowered to the ground. The rear panel of the case is also fitted with a plurality of feet, on which the case rests when the instrument is being placed in or is being withdrawn from the case. The outwardly-inclined bottom panel minimizes the complexity of the case by permitting the use of a two-piece—rather than a three-piece—top panel. Also for this embodiment, the lowermost edge of the cover lower portion is hingeably connected to the uppermost edge of the lower panel, with the cover upper and lower portions being hingeably interconnected along a line that is parallel to and spaced apart from the uppermost edge The case for storing, carrying and displaying a handheld musical instrument may also incorporate a humidifier in a portion of the case below where the neck of the instrument is positioned. The humidifier includes a container having a perforated lid. A damp sponge is placed within the container, thereby maintaining a relatively constant level of humidity within the case.

DETAILED DESCRIPTION OF THE PREFERRED EMBODIMENTS

The case for storing, carrying and displaying a handheld stringed musical instrument will now be described with reference to the included drawing figures. It should be understood that the drawings are merely representative of the invention, are not necessarily drawn to scale, and are not intended to limit the invention.

Figure 1:
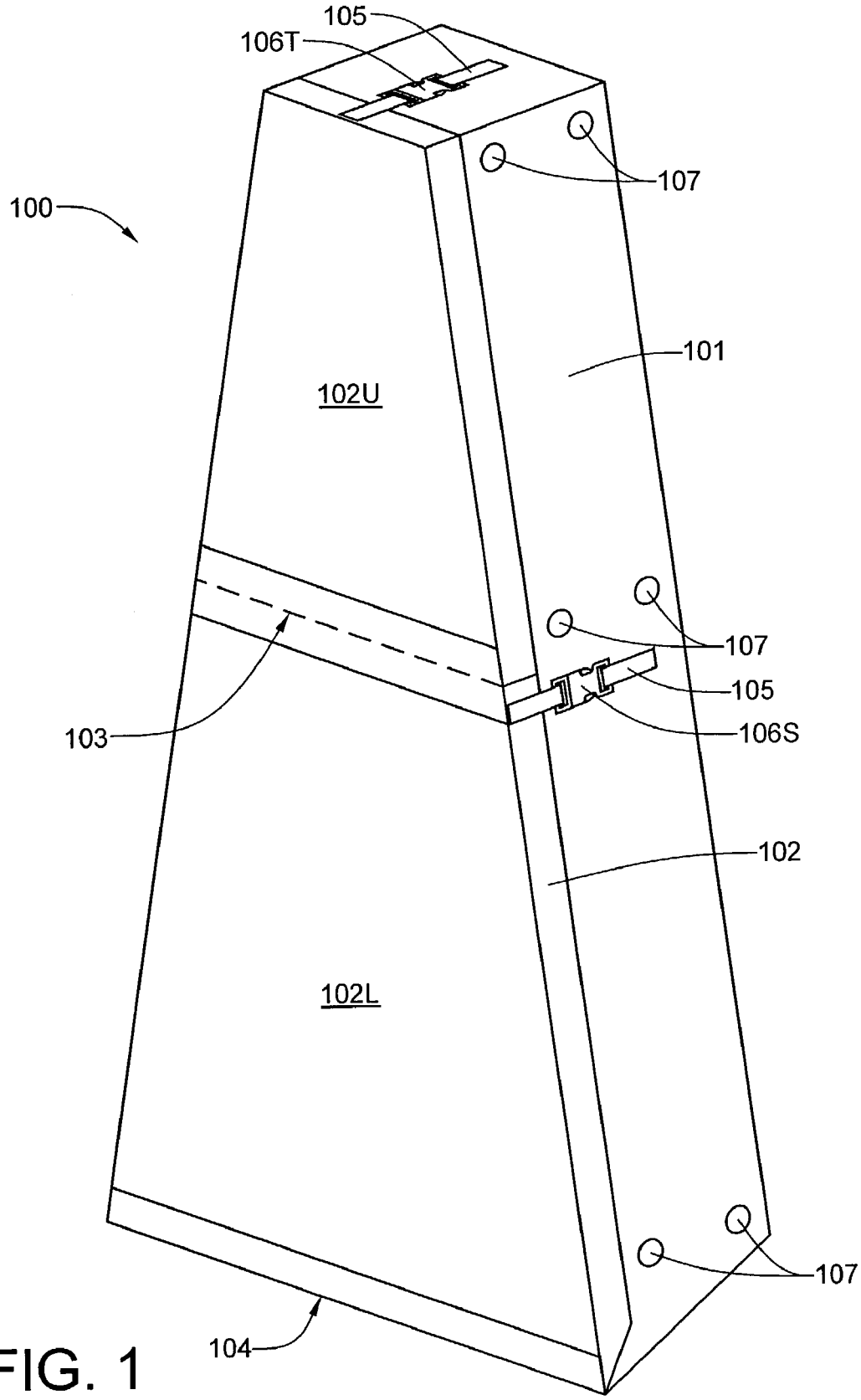
FIG. 1 is an isometric view of a first embodiment handheld stringed instrument carrying/display case fabricated in accordance with the present invention.

Referring now to FIG. 1, a first embodiment case 100 for storing, carrying and displaying a handheld stringed musical instrument is trapezoidally shaped, having a body 101 incorporating an instrument receptacle (not shown in this view), the body having a narrowed upper portion for receiving the neck of the instrument and a widened lower portion for receiving the body of the instrument. The case also has an articulated cover 102 securable to the main body 101 for reversably covering the instrument receptacle. The upper portion 102U of the articulated cover 102 folds back upon the lower portion 102L of the cover 102. The upper portion 102U and the lower portion 102L are joined at a hingeable joint along line 103. The lower portion 102L of the articulated cover 102 is hingeably connected along a linear edge 104 of the widened lower portion of the body 101, and is foldable beneath the body 101, and attachable to a medial portion of the back side of the main body. For a preferred embodiment of the invention, the linear edge 104 is unitary with a lower panel (not visible in this view) that is obliquely inclined so as to form an obtuse angle A (see FIG. 6) of about 110 to 120 degrees a back panel of the main body, thereby placing the case in a semi-recumbent position when the case is configured for display. For a preferred embodiment of the invention, the case is reclined about 20 to 30 degrees from vertical for the semi-recumbent display position. Straps 105 equipped with releaseable buckles 106 are used to secure the cover 102 to the main body 101. Releaseable buckle 106T is used to retain the upper portion 102U of the cover 102 to the main body, while releaseable buckle 106S is used to retain the lower portion 102L of the cover 102 to the main body. The main body 101 is also fitted with metal feet 107 for protection of the case covering or case finish from abrasion.

Figure 2:
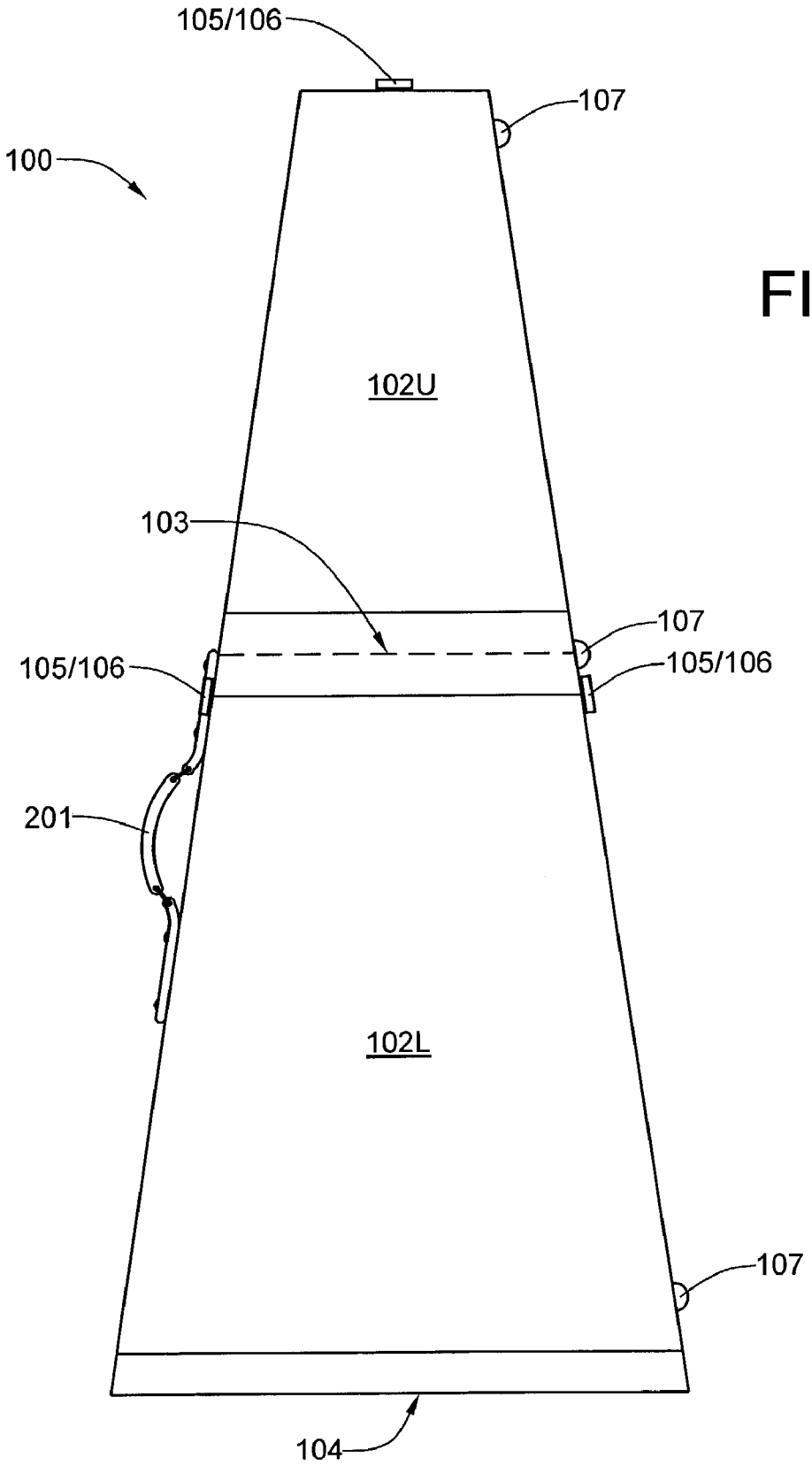
FIG. 2 is a top plan view of the first embodiment handheld stringed instrument carrying/display case.

Referring now to FIG. 2, a handle 201, which is secured to the main body 101 is visible in this elevational view.

Figure 3:
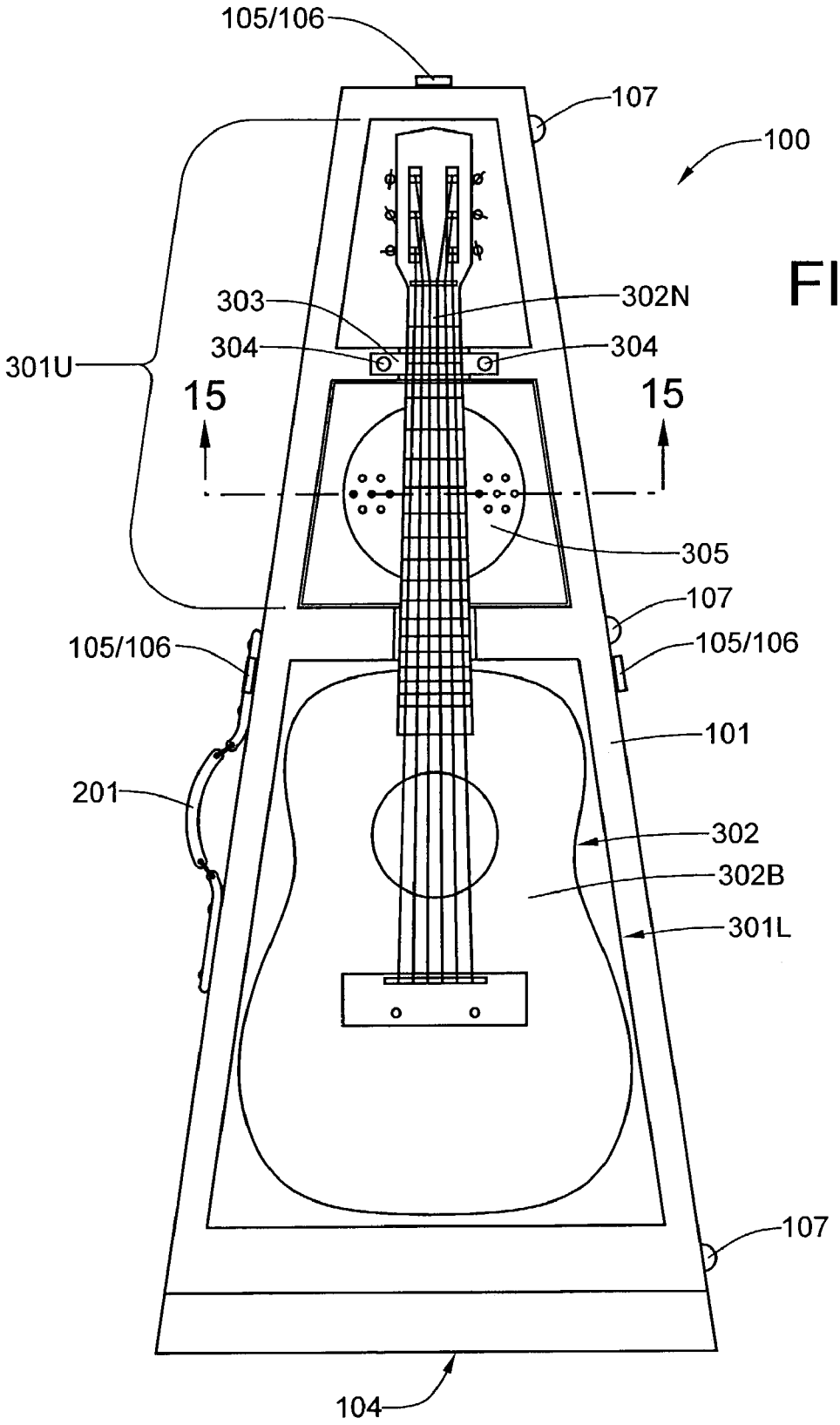
FIG. 3 is a top plan view of the first embodiment handheld stringed instrument carrying/display case, with the cover removed and containing a guitar.

Referring now to FIG. 3, the cover 102 has been removed from the first embodiment case to show the interior of the main body 101, which includes an instrument receptacle 301. It will be noted that the instrument receptacle 301 is tapered so that the body of the instrument fits in the wider lower portion 301L of the instrument receptacle 301 and the neck of the instrument fits in the upper portion 301U of the instrument receptacle 301. An acoustic guitar 302, having a hollow body 302B and a fretted neck 302N, is shown positioned within the instrument receptacle 301. It will be noted that a strap 303, having snaps 304 at both ends thereof, secures the neck 302N of the guitar 302 to the main body 101. The first embodiment case 100 also includes a built-in humidifier 305, which is later described in more detail with reference to FIG. 15.

Figure 4:
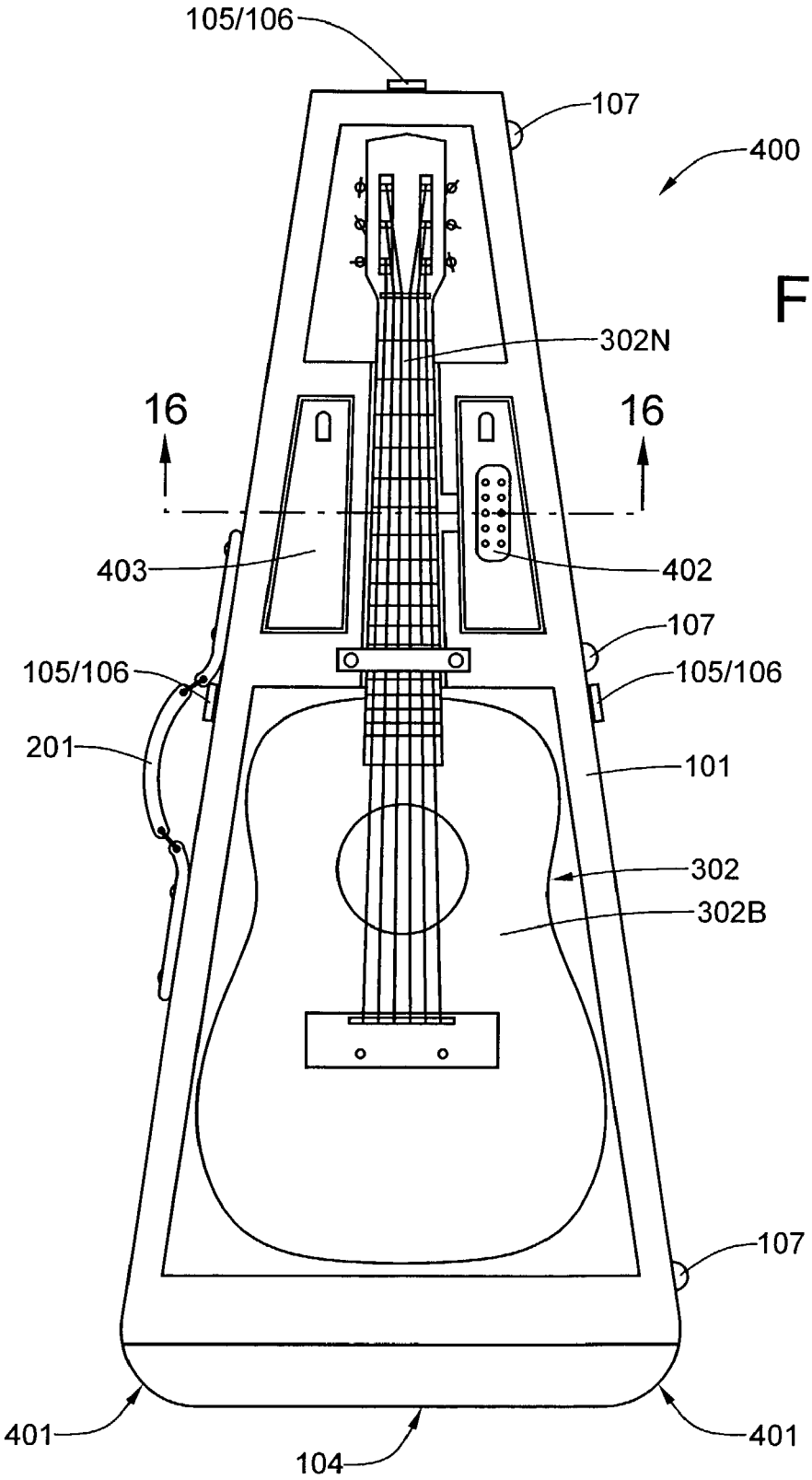
FIG. 4 is a top plan view of a second embodiment handheld stringed instrument carrying/display case, with the cover removed and containing a guitar.

Referring now to FIG. 4, a second embodiment case 400 is shown with the cover removed. The primary differences between the second embodiment case 400 and the first embodiment case 100 are the rounded exterior corners 401, the smaller built-in humidifier 402 and storage compartment 403 of the former. The second embodiment case 400 also differs from the first embodiment case 100 in that it omits the strap 304 in favor of a padded channel that is more narrow than the fretted neck 302N. Thus, the resiliency of the padding acts to retain the guitar 302 within the case.

Figure 5:
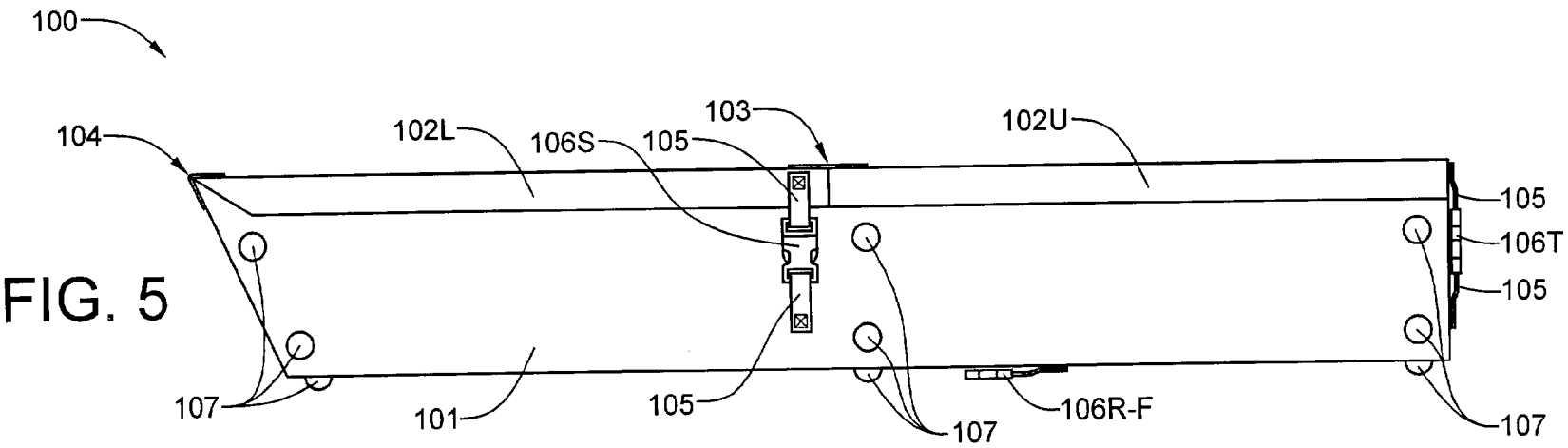
FIG. 5 is a right-side elevational view of a closed first embodiment handheld stringed instrument carrying/display case.

Referring now to FIG. 5, when the case is carried, the side visible faces the floor. Hence, it is also equipped with metal feet 107 for protection of the case.

Figure 6:
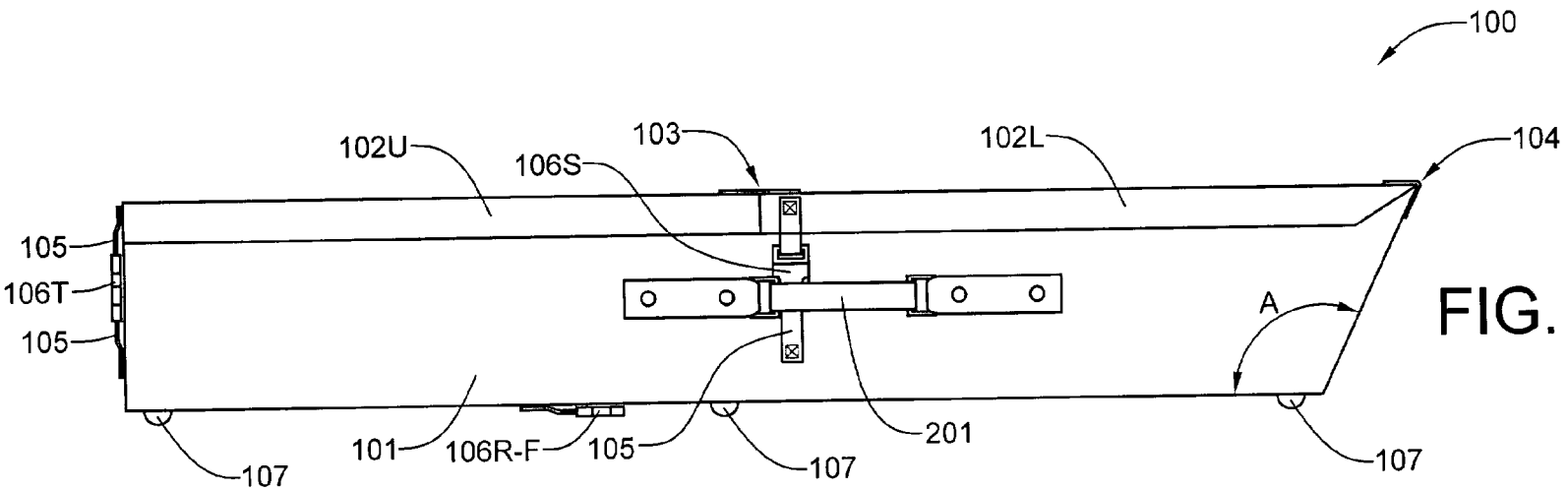
FIG. 6 is a left-side elevational view of a closed first embodiment handheld stringed instrument carrying/display case.

Referring now to FIG. 6, the case is carried by the handle 201, which is secured to the side of the main body 101. In the views of both FIG. 5 and FIG. 6, the obtuse angle A formed between the bottom panel 101B and the rear panel 101R is clearly visible in this view.

Figure 7:
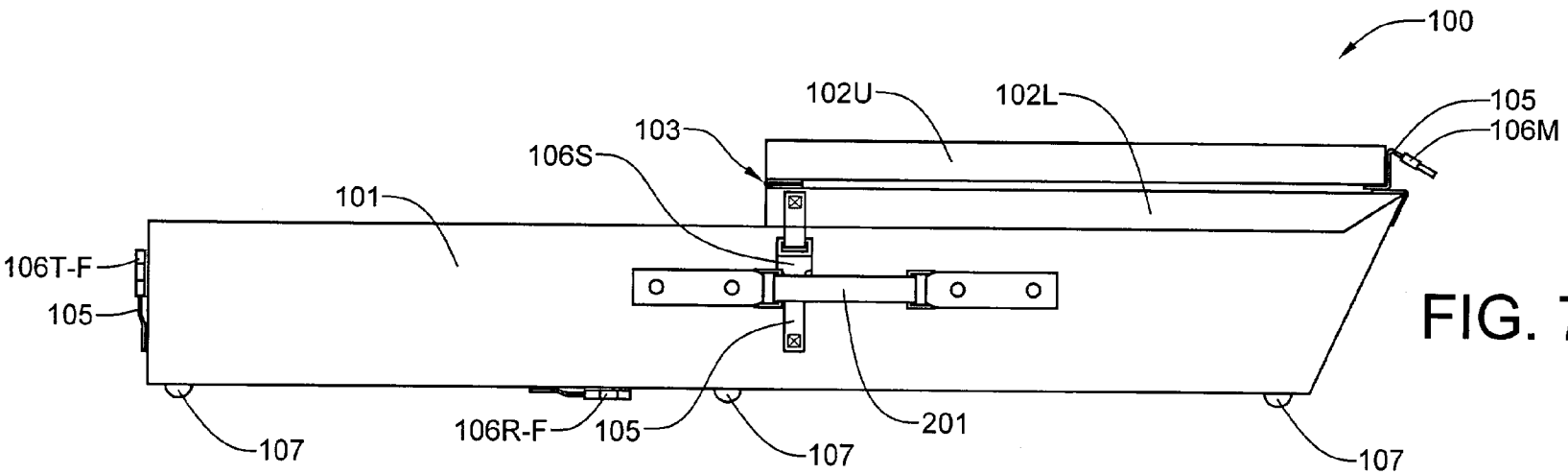
FIG. 7 is a left-side elevational view of a first embodiment handheld stringed instrument carrying/display, with the upper portion of the cover folded back on the lower portion of the cover.

Referring now to FIG. 7, the upper portion 102U of the articulated cover 102 has been folded back and on top of the lower portion 102L of the cover 102 by disengaging the male buckle 106T-M from the female buckle 106T-M at the top of the case 100.

Figure 8:
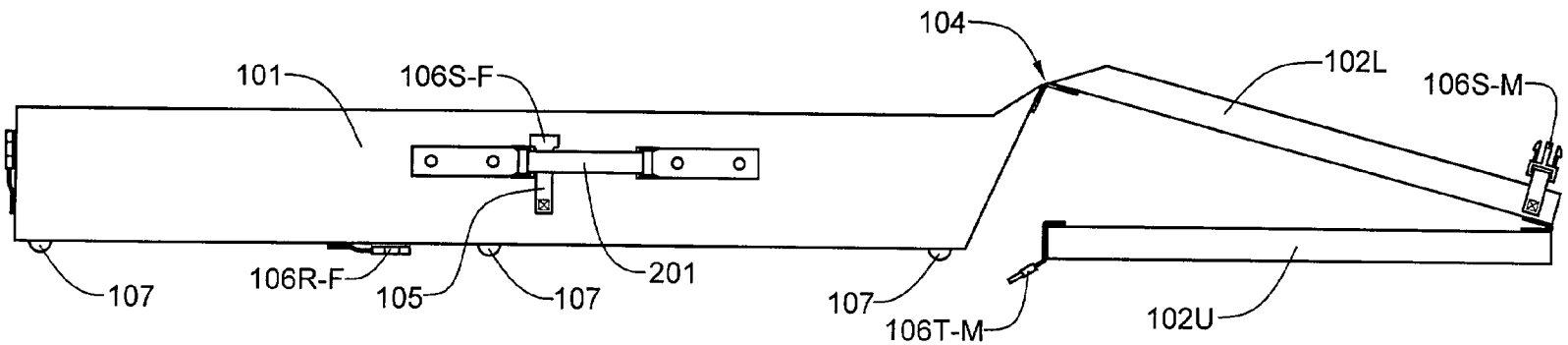
FIG. 8 is a left-side elevational view of a first embodiment handheld stringed instrument carrying/display, with both the upper and lower portions of the cover folded away from the case opening.

Referring now to FIG. 8, the buckles 106S securing the lower portion 102L of the cover 102 to the side panels 801 of the main body 101 have been released, thereby permitting the lower portion 102L to be folded outwardly from the main body 101. Each of the buckles 106S includes a female buckle 106S-F and a male buckle 106S-M. In this view, the upper portion 102U is shown folded beneath the lower portion 102L.

Figure 9:
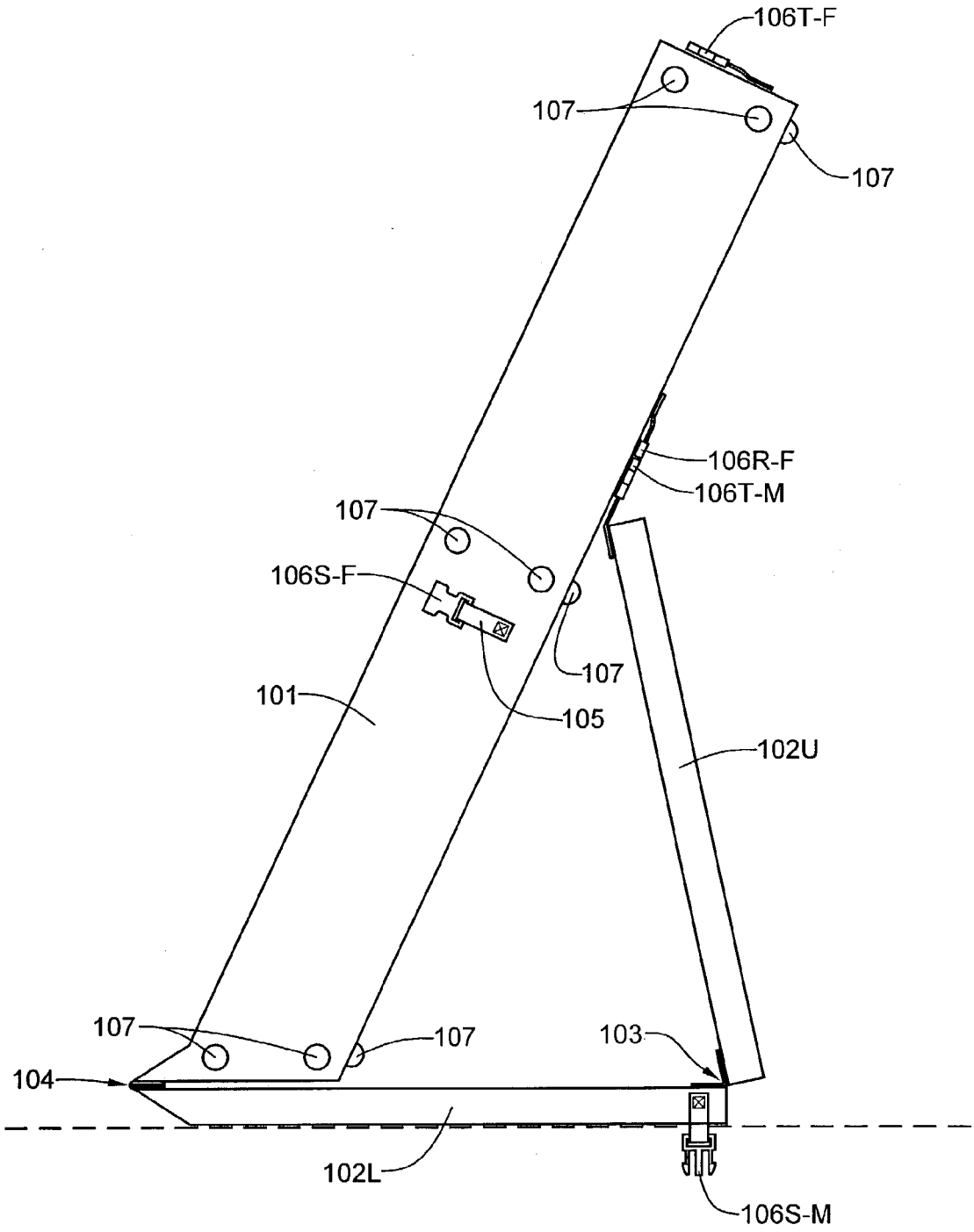
FIG. 9 is a right-side elevational view of a first embodiment handheld stringed instrument carrying/display case of FIG. 1 arranged in the display configuration, with the cover folded beneath the case and with the upper portion of the cover secured to the back side thereof.

Referring now to FIG. 9, the first embodiment case 100 for carrying, storing and displaying a handheld, stringed musical instrument has been set up in the display configuration. The lower portion 102L of the articulated cover 102 is folded beneath the bottom panel 101B and the upper portion 102U is folded upwardly so that the male half of the top buckle 106T-M may be secured to a female half of a buckle 106R-F affixed to a medial portion of the rear panel 101R of the main body 101. For this particular embodiment of the invention, the angle of reclination is about 25 degrees.

Figure 10:
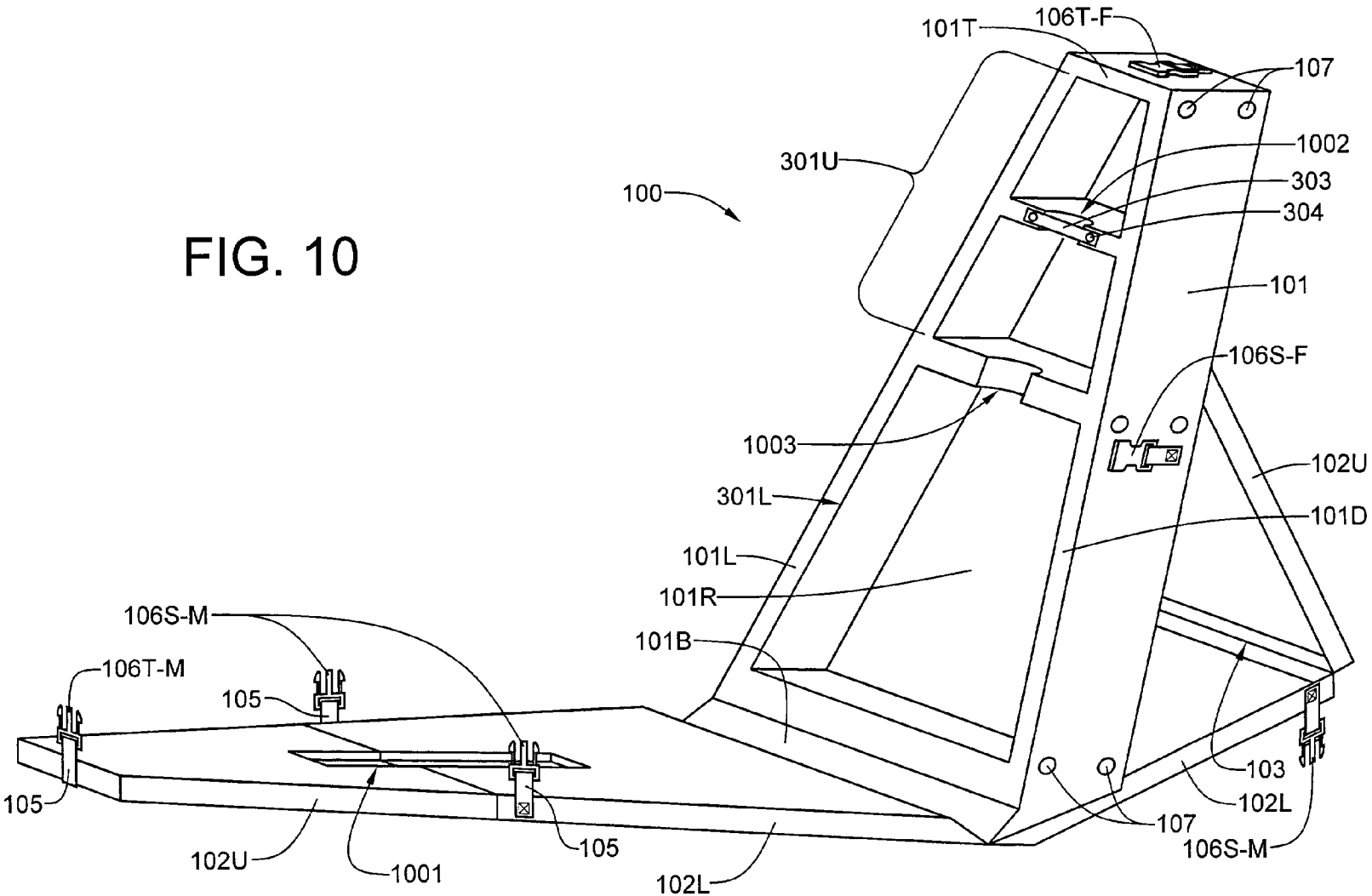
FIG. 10 is an isometric view of a first embodiment handheld stringed instrument carrying/display case, showing the cover open both in front of the case and attached behind to the bottom of the case in the display configuration.

Referring now to FIG. 10, an empty first embodiment case 100 is shown with the cover 102 positioned both in front of the main body 101 and positioned behind the main body 101, with the upper portion 102U of the articulated cover 102 attached to the outer surface of the rear panel 101R panel of the main body 101. It will be noted that both the upper portion 102U and the lower portion 102L of the cover 102 have a continuous channel 1001 that extends from about the sound hold region of the instrument to the tuning pin mounting block of the instrument.

Figure 11:
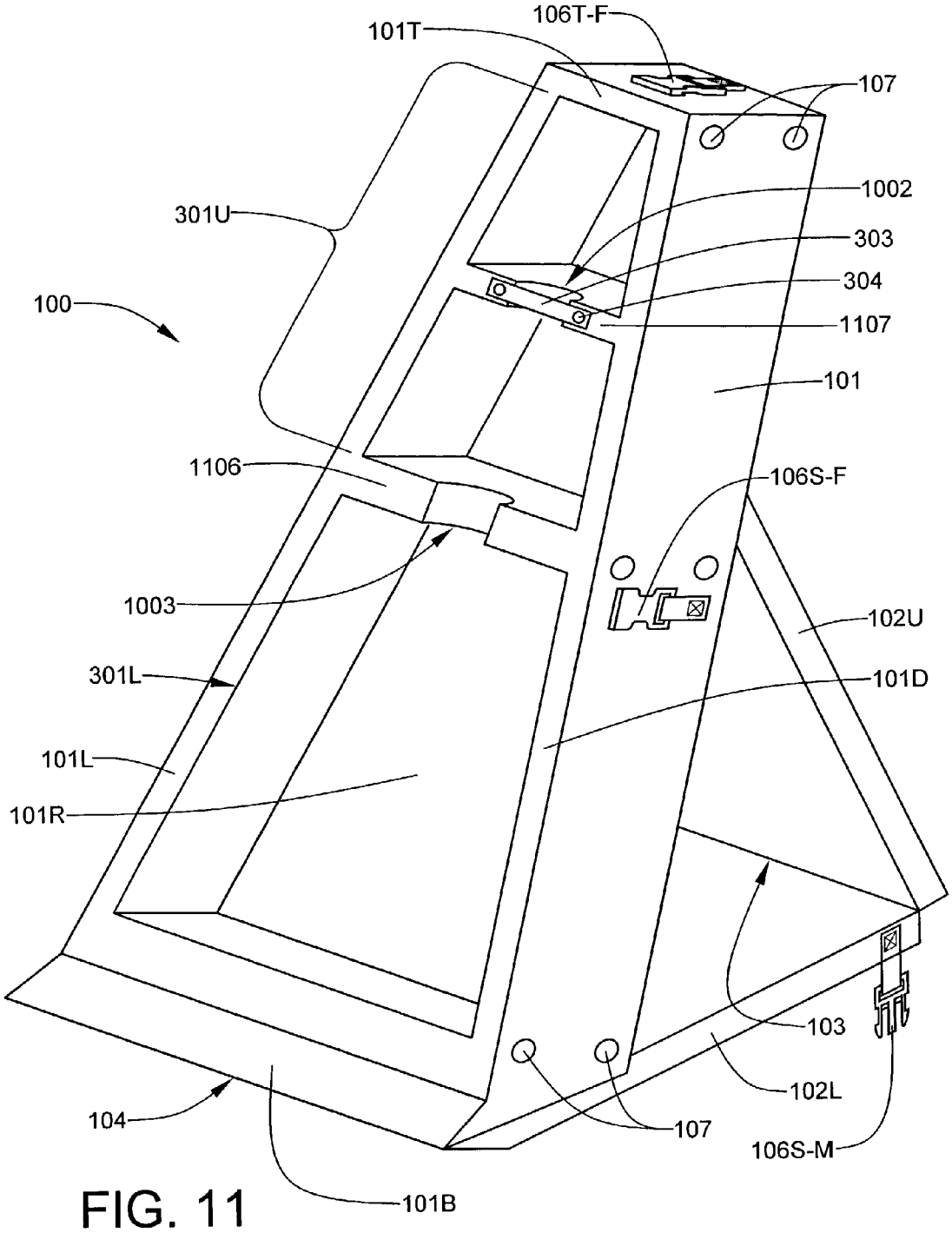
FIG. 11 is an isometric view of a first embodiment handheld stringed instrument carrying/display case, arranged in the display configuration.

Referring now to FIG. 11, an empty first embodiment case 100 is shown configured in the display mode in an isometric view. It will be noted that the configuration is particularly rigid and stable. This view of the first embodiment case 100 is particularly demonstrative of nearly all of the case components. The case 100 includes a right-side panel 101D, a left-side panel 101L, a rear panel 101R, a top panel 101T, a bottom panel 101B, a lower bulkhead panel 1106, and an upper bulkhead panel 1107. The cover 102 includes an upper portion 102U and a lower portion 102L. It will be noted that each of the bulkhead panels 1106 and 1107 contains a recess 1108 and 1109, respectively, into which the neck of the instrument fits.

Figure 12:
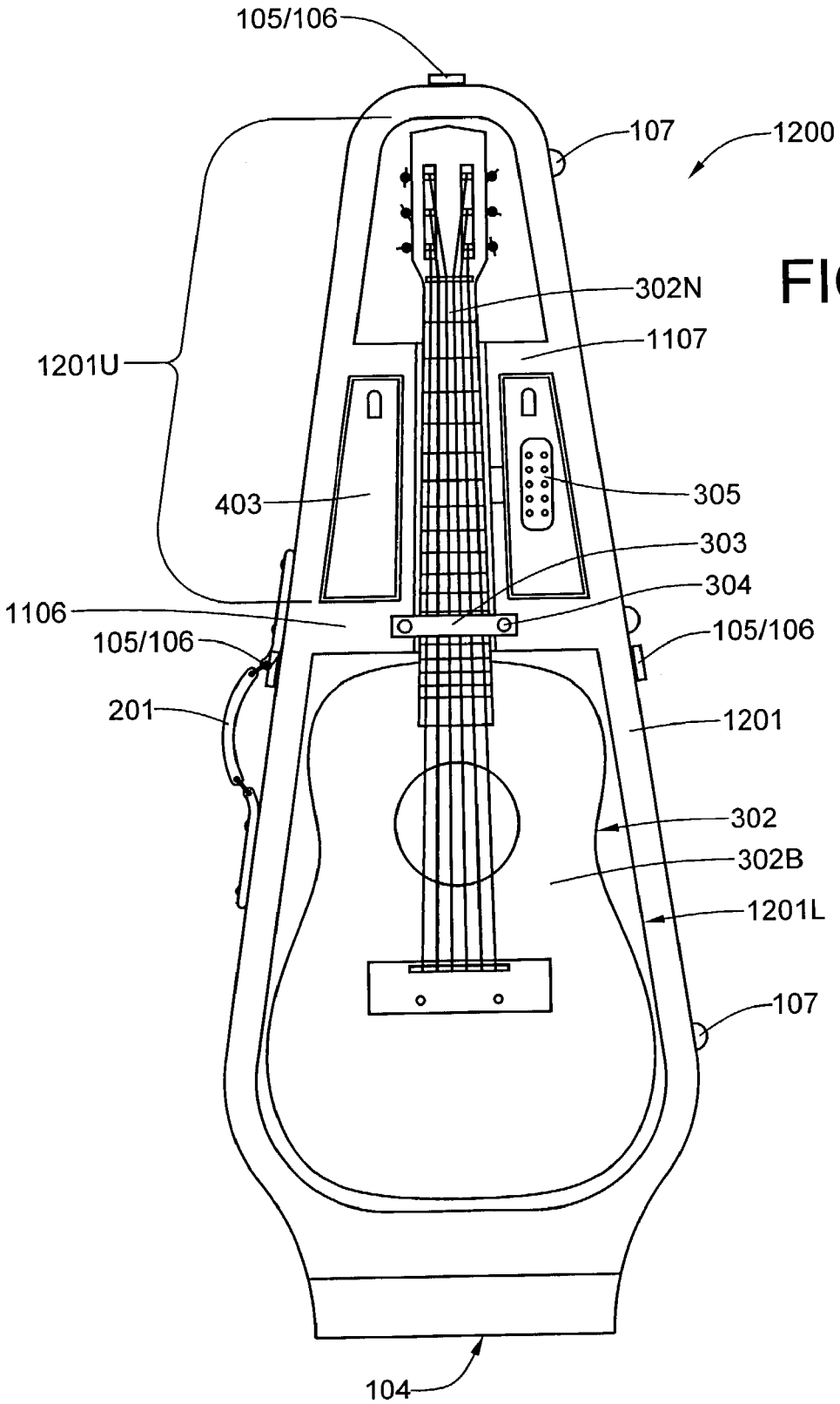
FIG. 12 is a top plan view of a third embodiment handheld stringed instrument carrying/display case, with the cover removed.

Referring now to FIG. 12, a second embodiment 1200 of the case for carrying, storing and displaying a handheld stringed musical instrument is shown. The corners of the main body 1201 have been rounded to make it more aesthetically more pleasing and to make the case 1200 more compact. In spite of the difference in appearance, the functional features are the same.

Figure 13:
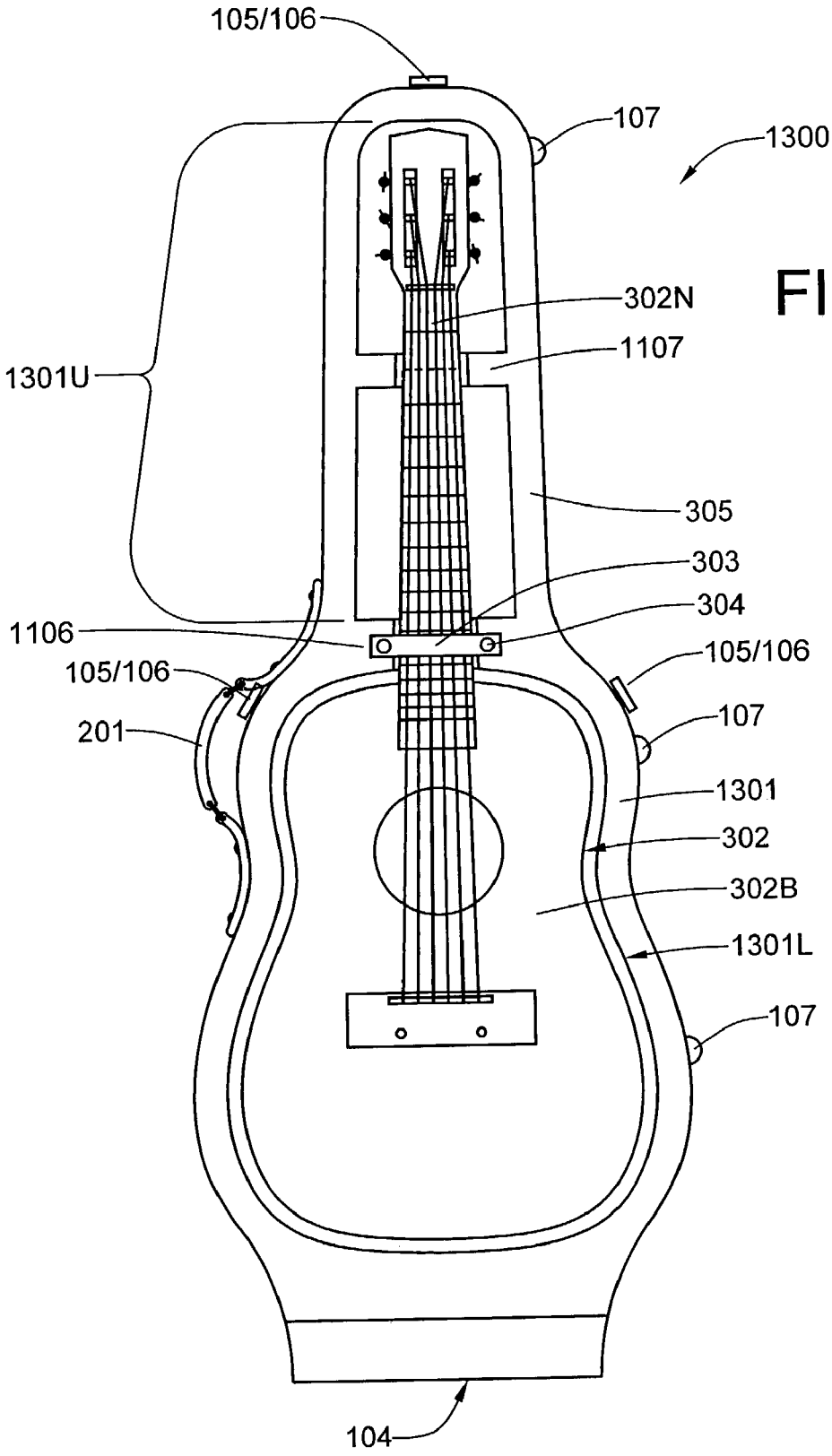
FIG. 13 is a top plan view of a fourth embodiment handheld stringed instrument carrying/display case, with the cover removed.

Referring now to FIG. 13, a third embodiment 1300 of the case for carrying, storing and displaying a handheld stringed musical instrument is shown. The main body 1301 of this embodiment closely fits the contours of the hollow-body acoustic guitar 401.

Figure 14:
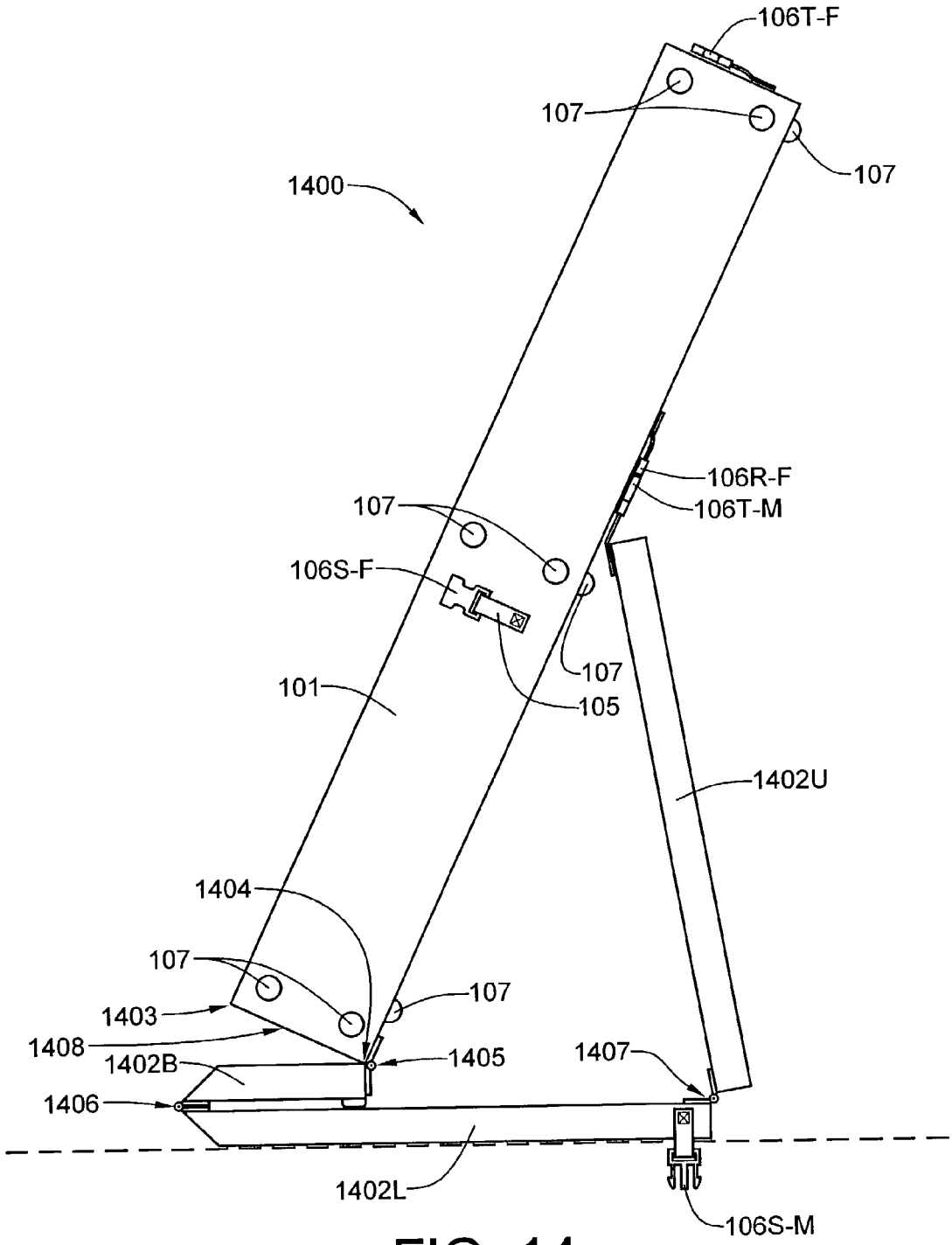
FIG. 14 is a right-side elevational view of a fifth embodiment handheld stringed instrument carrying/display case arranged in the display configuration, with the cover folded beneath the case and with the upper portion of the cover secured to the back side thereof.

Referring now to FIG. 14, a fourth embodiment 1400 of the case for carrying, storing and displaying a handheld stringed musical instrument is shown. This embodiment is designed to reduce the physical dimensions of the case by eliminating the outwardly inclined lower panel of the previous embodiments. The main body 1401 has a bottom panel that is square with the rear panel. The cover 1402, though still articulated, now consists of three hingeably interconnected panels, to wit, an upper portion 1402U, a lower portion 1402L, and a bottom portion 1402B. When the cover is secured to the front side of the main body 1401, the lower portion 1402L and bottom portion 1402B are perpendicular to one another. Only the bottom portion 1402B is hingeably connected to the main body 1401. Instead of being hingeably connected to the front edge 1403 thereof, it is hingeably connected to the rear edge 1404 with a rear-mounted hinge 1405. Hinge 1406, which is analogous to hinge 104 of the first embodiment case 100, interconnects the bottom and lower portions (1402B and 1402L, respectively) of the cover. Hinge 1407, which is analogous to hinge 103 of the first embodiment case 100, interconnects the lower and upper portions (1402L and 1402U, respectively) of the cover 1402. Hinge 1405 may be spring loaded so that the bottom portion 102B is biased to pivot towards the bottom panel 1408 of the main body 1401. This feature facilitates closing the cover 1402, as the releaseable buckles 106 are, then, automatically placed in alignment with their mates.

Figure 15:
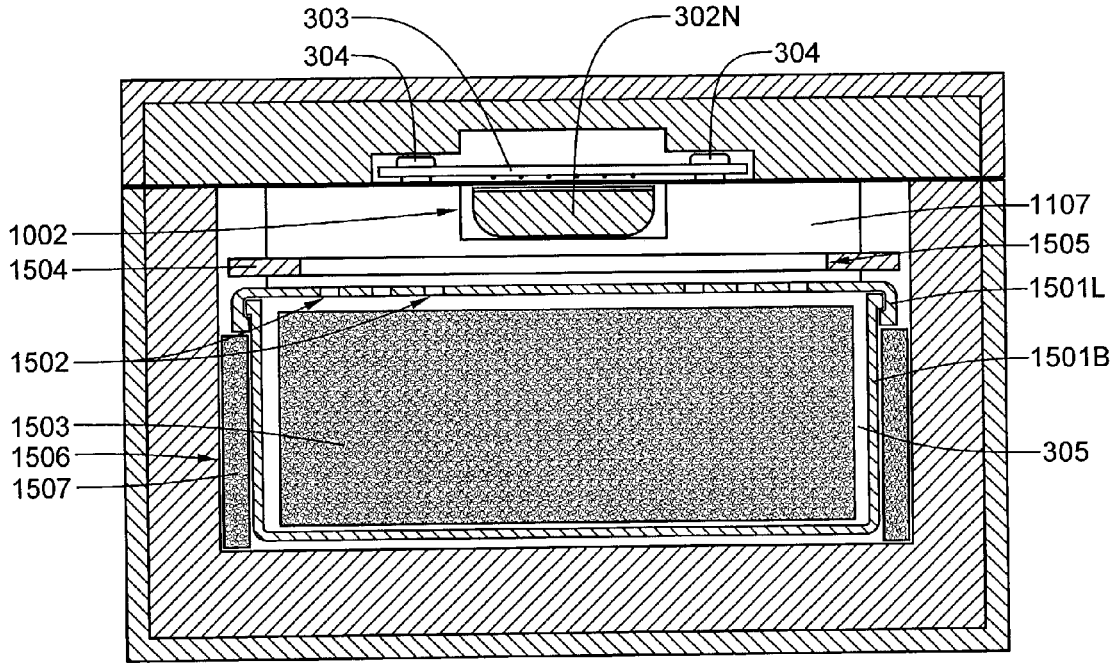
FIG. 15 is a cross sectional view through line 15—15 of FIG. 3, showing the built-in humidifier.

Referring now to FIG. 15, the details of the built-in humidifier apparatus 1500 are shown. The humidifier apparatus 1500, which fits within the space between the lower bulkhead panel 1106 and the upper bulkhead panel 1107, includes a container 1501 having a bowl shaped portion 1501B and a lid 1501L having a plurality of perforations 1502. A damp sponge 1503 is placed within the container 1501, thereby maintaining a relatively constant level of humidity within the case. The container 1501 is positioned beneath a panel 1504 in which an aperture 1505 is cut. The continuous channel 1001 of FIG. 10 provides a path through which humidity from the built-in humidifier apparatus 1500 can be distributed to the sound hole of the instrument and all along the fretted neck thereof. The container 1501 may be positioned within the recess 1506 with a piece of foam of either a rigid or flexible variety that is sized to fit the recess and which also has a cutout sized to receive the container 1501.

Figure 16:
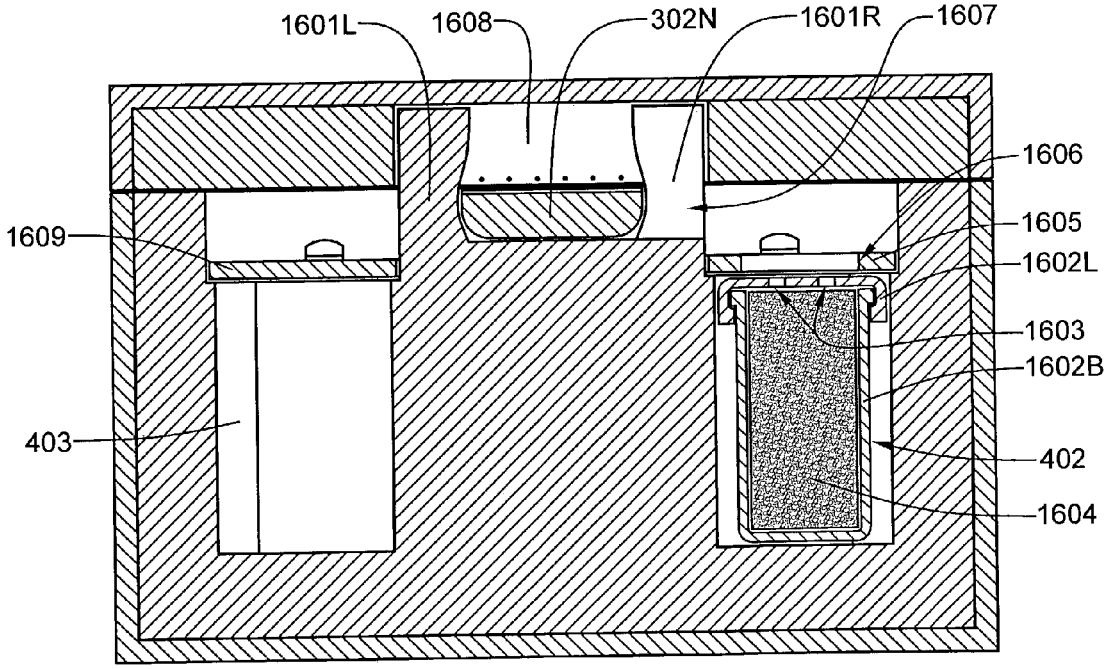
FIG. 16 is a cross sectional view through line 16—16 of FIG. 4, showing an alternative embodiment of the built-in humidifier.

Referring now to FIG. 16, the second embodiment case 400 includes both a built-in humidifier 403 and storage compartment 404. The second embodiment case 400 also differs from the first embodiment case 100 in that it omits the strap 304 in favor of a padded channel that is more narrow than the fretted neck 303N. Thus, the resiliency of the padding acts to retain the guitar 302 within the case. In this view, it will be noted that the fretted neck 303N is squeezed between left and right walls of padding 1601L and 1601R, respectively. The humidifier apparatus of the second embodiment case 400 includes a compact container 1602 having a rectangularly-shaped vessel portion 1502B and a lid 1602L having a plurality of perforations 1603. A damp sponge 1604 is placed within the container 1602, thereby maintaining a relatively constant level of humidity within the case. The compact container 1602 is positioned beneath a panel 1605 in which an aperture 1606 is cut. Water vapor is transmitted through the perforations 1603, through the aperture 1606, through a connecting channel 1607 to the main longitudinal channel 1608 which extends along the length of the fretted neck 303N to the sound hole in the instrument body.

It should be obvious to those having ordinary skill in the art that a variety of hinges may be used to interconnect the upper and lower cover portions (102U and 102L, respectively) of the cover 102, as well as to interconnect the cover 102 to the main body 101. For example, multiple individual hinges may be used for each joint, or a hinge extending the entire length of the hingeable joint may be employed. The types of hinges may include miniature versions of door and piano hinges, which have separate hinge pieces held together a pivot pin, bendable fabric hinges sewn to each of the joined members, or a live hinge of bendable thin polymeric material.

Although only several embodiments of the invention have been disclosed herein, it will be obvious to those of ordinary skill in the art, that changes and modifications may be made thereto, without departing from the spirit and scope of the invention as hereinafter claimed.

What is claimed is:

1. A case for storing, carrying and displaying a handheld stringed instrument characterized as having an enlarged body and a narrow neck with a fingerboard, said case comprising:

a main body that is generally symmetrical about a longitudinal axis, said main body having an open instrument receiving cavity located therein, said instrument receiving cavity being at least as long as an instrument to be positioned within the case, said instrument receiving cavity having a lower portion for the body of an instrument and an upper portion for the neck thereof, said instrument receiving cavity being formed, in part, by a back panel and a bottom panel, said bottom panel intersecting and being continuous with said back panel, said bottom panel being the main body component most distant from the upper portion of the instrument receiving cavity;

a cover having a bottom cover portion for covering said bottom panel, an upper cover portion for covering at least a portion of said instrument receiving cavity upper portion, and a lower cover portion hingeably interconnected to both said bottom cover portion and said upper cover portion, said lower cover portion for covering at least a portion of said instrument receiving cavity lower portion, said bottom, lower and upper cover portions having outer and inner surfaces, said inner surfaces being reversibly securable to said main body, said bottom cover portion being hingeably connected to the bottom panel along a linear joint that is both perpendicular to said longitudinal axis and parallel to said back panel, said linear joint being located along a rear bottom edge of said main body, said bottom cover portion hinging away from said bottom panel, the outer surface of said lower cover portion folding back onto the outer surface of said bottom cover portion, said upper cover portion folding behind said back panel, and an upper edge of said upper cover portion reversably attaching to said back panel to establish a display mode configuration for the case.

2. The case of claim 1, wherein said cover is securable to said main body with a plurality of buckles, each of which has male and female portions.

3. The case of claim 1, wherein said upper cover portion is reversably attachable to said back panel by means of a buckle having male and female portions.

4. The case for storing, carrying and displaying a handheld stringed instrument of claim 1, wherein said main body and said cover are generally trapezoidally shaped.

5. The case for storing, carrying and displaying a handheld stringed instrument of claim 1, which further comprises a humidifier apparatus installed in said upper portion of said instrument receiving cavity, and wherein an inner side of said cover incorporates a channel that is in communication with said humidifier apparatus, humidity expelled from said humidifier apparatus being distributed to the body and neck of an instrument stored within the closed case through said channel.

6. The case for storing, carrying and displaying a handheld stringed instrument of claim 5, wherein said humidifier apparatus is a container having a watertight bowl, a perforated lid securable to the container, and a water-absorbing device enclosed within the container.

7. A case for storing, carrying and displaying a handheld stringed instrument having an enlarged body and a narrow neck attached to the enlarged body, said case comprising:

a main body having a plurality of intersecting panels which define an instrument receiving cavity, said instrument receiving cavity having an instrument-sized opening through which the instrument may be placed within the instrument receiving cavity, said instrument receiving cavity also having a lower cavity portion for receiving the body of the instrument and an upper cavity portion for receiving the neck of the instrument, said lower portion having a linear edge associated with one of said intersecting panels that is located a maximum distance from the upper cavity portion along a rear bottom edge of said main body;

a cover for covering the instrument receiving cavity, said cover being hingeably connected to said main body at said linear edge, said cover comprising a bottom cover portion hingeably connected to said linear edge, an upper cover portion, and a lower cover portion hingeably interconnected to both said bottom cover portion and said upper cover portion via linear hinge joints that are parallel to said linear edge, said bottom cover portion covering a bottom panel of said main body when said cover is closed, said upper cover portion for covering said upper cavity portion, said lower cover portion for covering said lower cavity portion, said upper and lower cover portions being foldable, at least partially, beneath said instrument receiving cavity such that an upper edge of said upper cover portion is reversibly connectable to a medial rear portion of said main body, said bottom cover portion hinging away from said bottom panel when said upper cover portion is connected to said medial rear portion.

8. The case for storing, carrying and displaying a handheld stringed instrument of claim 7, wherein said front and back sides are generally trapezoidally shaped.

9. The case for storing, carrying and displaying a handheld stringed instrument of claim 7, wherein said case is generally symmetrical about a longitudinal axis, and said cover is hinged to said main body along a bottom linear edge thereof, said bottom linear edge being generally perpendicular to said longitudinal axis.

10. The case for storing, carrying and displaying a handheld stringed instrument of claim 7, which further comprises a humidifier apparatus installed in said upper portion of said instrument receiving cavity, and wherein an inner side of said cover incorporates a channel that is in communication with said humidifier apparatus, humidity expelled from said humidifier apparatus being distributed to the body and neck of an instrument stored within the closed case through said channel.

11. The case for storing, carrying and displaying a handheld stringed instrument of claim 10, wherein said humidifier apparatus is a container having a watertight bowl, a perforated lid securable to the container, and a water-absorbing device enclosed within the container.

12. A case for storing and carrying a handheld stringed musical instrument, the case comprising:

a receptacle component having a recess sized to receive the instrument, said recess having an enlarged portion for the instrument's sound box and a narrowed portion for the instrument's neck;

a cover having hingeably interconnected multiple portions for sealing the recess of the receptacle component, said cover hinged at a bottom edge of said receptacle component and incorporating a channel;

a humidifier apparatus positioned within the narrowed portion of the receptacle, said humidifier apparatus including a container having a watertight bowl, a perforated lid securable to said bowl, and a water-absorbing device enclosed within said container; and wherein said channel is in communication with said humidifier apparatus, so that humidity expelled from said humidifier apparatus is distributed to the soundbox and neck of an instrument stored within the closed case through said channel.

13. The case of claim 12, wherein said water absorbing device is a sponge.

14. The case of claim 12, wherein said water absorbing device is a cloth woven of synthetic fibers.

15. The case of claim 12, wherein said bowl and lid are fabricated from polyethylene plastic material.

16. The case of claim 12, wherein said humidifier apparatus is affixed within the narrowed portion.

* * * * *